US005290594A

United States Patent [19]

Groshens et al.

[11] Patent Number: 5,290,594

[45] Date of Patent: Mar. 1, 1994

[54] METHOD FOR PRODUCTION OF THERMOADHESIVE FABRIC COVERINGS, THERMOADHESIVE FABRIC COVERING

[75] Inventors: Pierre Groshens, Flamicourt; Demoulin Bernard, Barleux, both, France

[73] Assignee: Lainiere De Picardie, Peronne, France

[21] Appl. No.: 822,536

[22] Filed: Jan. 17, 1992

[30] Foreign Application Priority Data

Feb. 5, 1991 [FR] France ..... 91 01287

[51] Int. Cl.[5] ..... B05D 5/00

[52] U.S. Cl. ..... 427/244; 427/208.6; 427/208.8; 427/381; 427/389.9; 427/394; 427/428

[58] Field of Search ..... 427/244, 278, 359, 365, 427/366, 381, 389.9, 208.6, 208.8, 394, 428

[56] References Cited

U.S. PATENT DOCUMENTS

| | | | |
|---|---|---|---|
| 3,591,407 | 7/1971 | Petersik et al. | 427/389.9 |
| 3,679,456 | 7/1972 | Young | 427/389.9 |
| 4,156,888 | 10/1992 | Haubs et al. | 427/163 |
| 4,472,463 | 9/1984 | Solomon | 427/381 |

*Primary Examiner*—Anthony McFarlane
*Attorney, Agent, or Firm*—Kane, Dalsimer, Sullivan, Kurucz, Levy, Eisele and Richard

[57] ABSTRACT

A method of producing a thermoadhesive fabric covering includes applying in spots a dual coating of thermoadhesive polymers to a textile support which is then dried and cooled.

18 Claims, 3 Drawing Sheets

METHOD FOR PRODUCTION OF THERMOADHESIVE FABRIC COVERINGS, THERMOADHESIVE FABRIC COVERING

FIELD OF THE INVENTION

The invention relates to a thermoadhesive fabric covering and its method of production.

It is well known to produce thermoadhesive fabric coverings constituted by a textile support on which there is deposited, by coating, a layer of thermoadhesive polymers which is distributed in spots.

These fabric coverings are intended to be laminated onto another textile, for example a cloth, so as to constitute a complex, the physical properties of which, firmness, nerve, flexibility, feel, volume etc., can be controlled.

These properties of the complex are the result of the nature of the cloth, of the nature of the textile support of the fabric covering and also of the nature, of the composition and of the manner of application of the thermoadhesive layer.

After being manufactured, the thermoadhesive fabric covering must be capable of being stored at ambient temperature. It is therefore necessary that the different layers of this product, which is generally stored in rolls, do not stick to one another. The thermoadhesive fabric covering must not have any tack.

The thermoadhesive fabric covering is subsequently laminated onto the cloths so as to obtain the desired complex.

This lamination is in most cases carried out with the aid of a press which functions at temperatures between 100° C. and 180° C. at pressures of a few decibar to a few bar for relatively short periods, of the order of 10 to 30 seconds.

During this phase, the thermoadhesive polymers of the fabric covering must at least partially recover their property of adhesion.

During this operation, it is necessary to avoid these thermoadhesive polymers striking through the cloth or striking back, that is to say striking through the textile support of the fabric covering.

Such strike-through or strike-back would in fact produce an unattractive esthetic effect, rendering the fabric covering unsuitable for use or, at least, would impart to the complex unfavorable properties contrary to those desired.

PRIOR ART

The document TEINTEX, vol. 37, no. 11, 1972, PARIS (pages 601–606) indicates the products used in thermoadhesion and the methods and materials for making use of them.

From the first use of thermoadhesive fabric coverings, the phenomena of strike-through and strike-back were noted and numerous attempts have since been made to avoid these faults.

In particular, attempts have been made to deposit on a textile support a number of successive layers of polymers which have different properties.

American Patent U.S. Pat. No. 2,631,947 decribes a thermo-adhesive fabric intended for repairing, which comprises a textile support and two layers of adhesive which are continuous and of different viscosities. The layer in contact with the support has a melting point which is higher than that of the surface layer. Thus, the adhesion of the fabric to the cloth to be repaired is facilitated, its firmness during successive washings is improved and strike-through is avoided.

Documents GB-A-L 133 331 and GB-A-L 360 496 propose a fusible fabric covering intended for the garment industry, which comprises a textile covered with a discontinuous adhesive layer constituted by a first thermoplastic material, each spot then being covered with a second polymeric material which may be heat-cross-linkable or have a higher melting point than the first material.

More recently, according to patent FR-2 177 038, it has been proposed to make a fabric covering by successively depositing two layers of adhesive on a support. The first layer is made by coating by screen-printing of a viscous dispersion containing polymers of high viscosity and/or with a high melting point.

The second layer is made by sprinkling a powder of thermoadhesive polymers of viscosity and/or with a melting point lower than those of the first layer.

Making a second layer by sprinkling onto a first viscous layer does not allow good regularity of the second layer to be obtained. Moreover, the spots formed by this second layer in most cases extend beyond the spots formed by the first layer, which leads to strike-through at the time of lamination.

According to documents FR-2 318 914 and FR-2 346 058, it has been proposed to coat the textile support simultaneously with two layers of polymers in the form of dry powder with the aid of a deep-engraved cylinder. The underlayer in this case also consists of polymers of a viscosity and/or with a melting point higher than those of the second layer.

The coatings made in the dry way by deep-engraved cylinder suffer from a lack of mechanical cohesion of the two layers of polymers in relation to one another. The interface of the two layers constitutes a zone of weakness and garments made with fabric coverings of this type do not withstand care treatments well.

According to German Patent p 2 461 845.9, simultaneous coating, by screen-printing frame, has been proposed, with two layers of viscous dispersion con-taining polymers of viscosity and/or with a melting point which are different. The two pastes are delivered in the same frame by two separate juxtaposed scrapers.

This technique is extremely awkward, not to say impossible, to implement. Experience has shown that it is not possible to fill the holes of the gravure cylinders without all or part of the dispersion being deposited on the textile support. The coating thus creates, on the textile support, strike-through of a mixture of the two dispersions, which does not allow a quality fabric covering to be obtained.

Finally, according to patent FR-2 576 191, which belongs to the Applicant making the present application, it is proposed to make successive coatings of two layers of polymers, of viscosity and/or with a melting point which are different, these two layers being deposited on both sides of the textile support.

SUMMARY OF THE INVENTION

The aim of the present invention is therefore the production of a thermoadhesive fabric covering and its method of production, which make possible simple industrial utilization which allows quality products to be obtained.

To this end, the invention relates to a method for production of thermoadhesive fabric coverings, in which a textile support receives a coating of thermoadhesive polymers distributed in spots.

According to the invention, the textile support is temporarily bonded onto a conveyor belt, an underlayer of polymers distributed in spots is deposited on the textile support by a first rotary frame, an upper layer of thermoadhesive polymers with a distribution in spots identical to that of the underlayer is deposited on the latter by a second rotary frame, the coated textile support is separated from the conveyor belt, the coated textile support then passes through a continuous drying furnace and then it is cooled.

According to different preferred embodiments, the conveyor belt forms a closed loop, it is washed after having been separated from the coated textile support and before receiving a new textile support element to coat. I Preferably, the speed of rotation of the second rotary frame, its angular setting and the speed of advance of the support belt are controlled by the speed of rotation of the first rotary frame in such a manner that the peripheral speeds of these frames are equal to the speed of advance of the support belt and that each spot of the upper layer is deposited on a spot of the lower layer.

For each spot, the dimension of the perforation of the second rotary frame is equal to or advantageously smaller than that of the perforation of the first rotary frame.

The polymers of the underlayer are at least partially crosslinked after being deposited on the textile support.

Preferably, the polymers of the upper layer are heat-fusible and deposited in the form of paste.

They can likewise be deposited in the form of foam.

The underlayer can contain at least one agent capable of reacting with the thermoadhesive polymers of the upper layer and the underlayer can be dried after being deposited on the textile support and before the upper layer is deposited.

The invention also relates to a thermoadhesive fabric covering which comprises a textile support and a thermoadhesive coating distributed in spots on one of its faces.

According to the invention, each spot of the coating comprises an underlayer formed from polymers and an upper layer formed from thermoadhesive polymers.

The underlayer of each spot is preferably formed from heat-stable crosslinked polymers.

The upper layer of each spot has a surf ace area which is at the most equal to that of the underlayer; preferably it is smaller.

Preferably, the thermoadhesive properties of the upper layer vary progressively from the zone of contact with the underlayer to its upper zone.

In a preferred embodiment, the underlayer comprises polymers belonging to the group formed by crosslinkable silicones, polyfluoro-compounds, cross-linkable polyurethanes, and polyacrylates.

The upper layer itself preferably comprises polymers belonging to the group formed by the polyamides, copolyamides, polyesters, copolyesters, polyurethanes, and polyethylenes.

According to another preferred embodiment, the upper layer comprises polymers having a reactive function belonging to the group including copolymers styrene-ethyl acrylate, melamines, aziridine, isocyanates, unsaturated polyesters and epoxy resins.

BRIEF DESCRIPTION OF THE DRAWINGS

The invention will be described in greater detail with reference to the attached drawings, in which.

DESCRIPTION OF THE PREFERRED EMBODIMENT(S)

Figure 1:
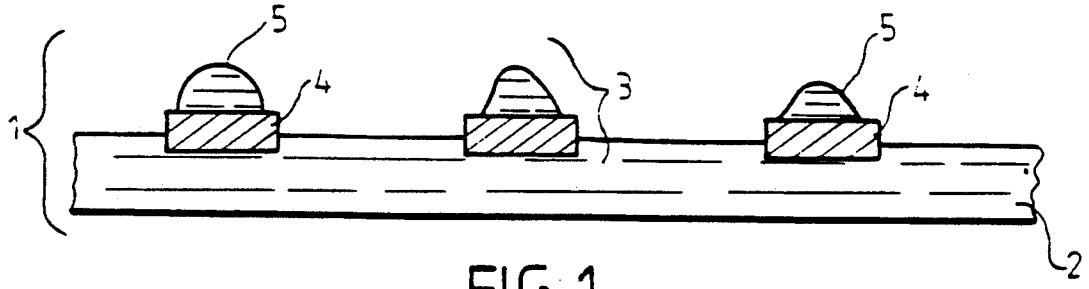
FIG. 1 is a diagrammatic representation of the fabric covering, the subject of the invention.

With reference to FIG. 1, the fabric covering 1 comprises a textile support 2 and thermoadhesive spots 3.

The textile support 2 is known per se. It is of the same type as those conventionally used in the field of fabric coverings.

It may be a woven or knitted or non-woven textile. In most cases, these textiles are converted, and then subjected to finishing operations before being used as a coating support.

Cotton or staple fiber fabrics can be used. However, the best results have been obtained with textured polyester fabrics or non-woven voiles, the binding of which avoids the risk of fluffing. More generally, the use of a fabric made of synthetic multifilament continuous yarns of the flat or textured type is particularly suitable.

Figure 2:
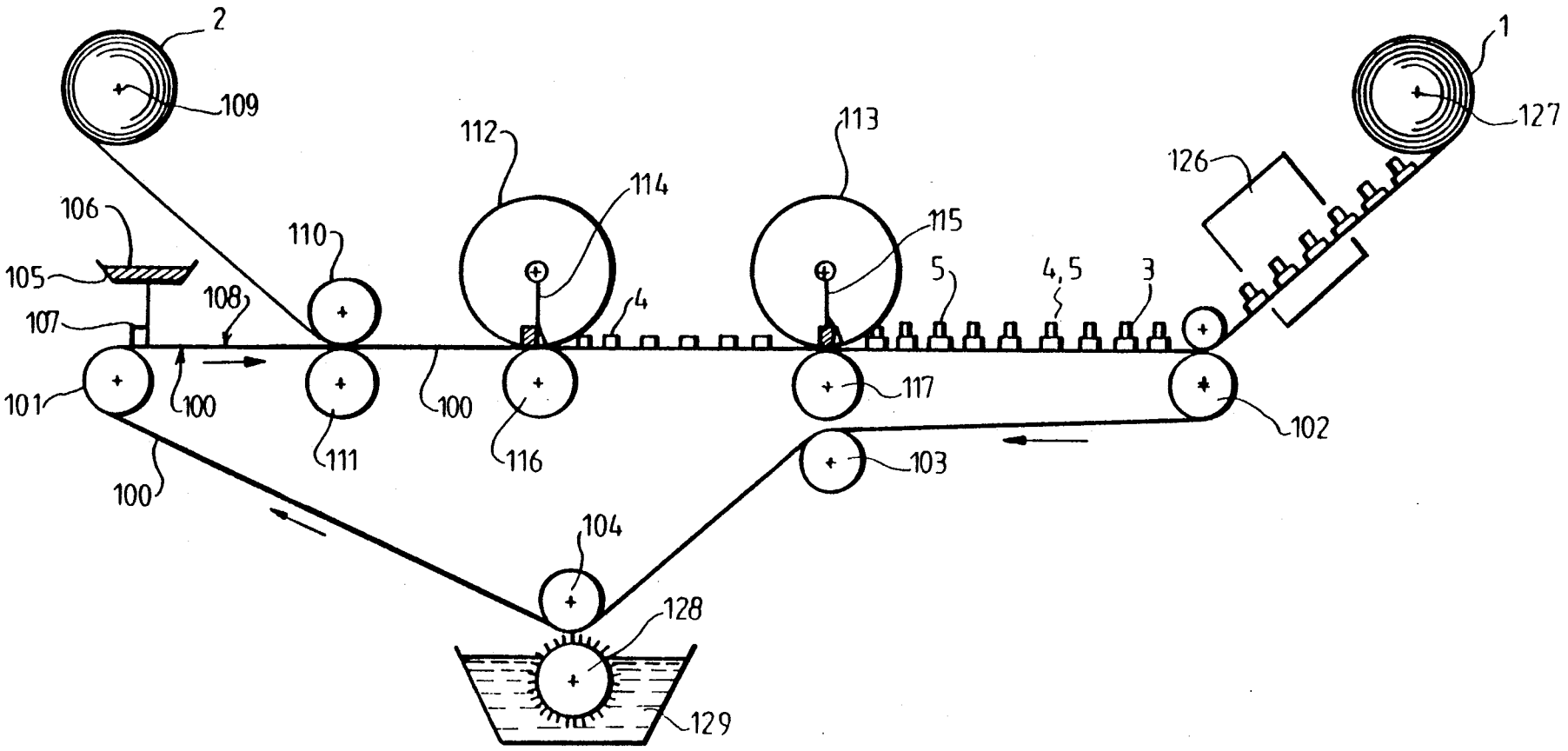
FIG. 2 is a diagrammatic representation of the equipment of the invention in a first embodiment.
Figure 3:
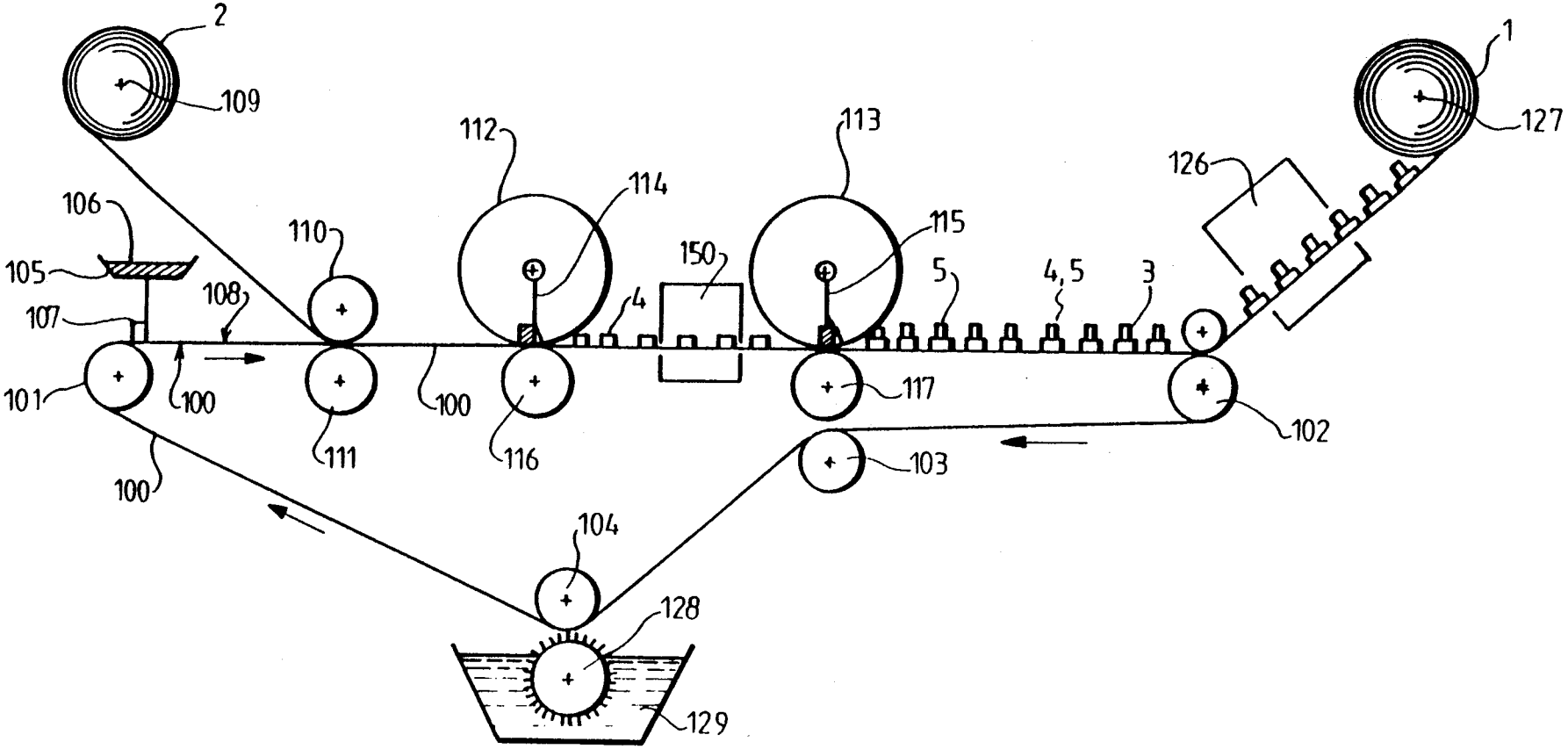
FIG. 3 is a diagrammatic representation of the equipment of the invention in a second embodiment.

Unless noted otherwise, the following description of the preferred embodiments pertains to both FIGS. 2 and 3.

In a first stage, the textile support 2 is bonded onto a conveyor belt 100. See FIGS. 1, 2, and 3.

To this end, the conveyor belt 100, which preferably forms a closed loop, travels on transport cylinders 101–104.

The conveyor belt 100 is preferably made from a polyester textile covered with a layer or a covering of crosslinked silicone polymers. It is important that this belt has very good dimensional stability, in particular in the longitudinal direction. In fact, as will be seen below, it is subjected to great traction forces and temperature differences which must not cause relative displacements of the spots of the textile support 2 stuck to it. It can also be made from a fabric made of glass fibers or of aramid fibers likewise covered with a layer or a covering of crosslinked silicone polymers.

The transport cylinders 101-104 associated with guide means (not shown) ensure the travel of the belt perpendicularly to the axes of the frames 112 and 113 and ensure the stability of the position of the belt 100 parallel to these axes. A cylinder known as a deformation cylinder can be used to facilitate this adjustment.

A reservoir 105 contains the aqueous adhesive 106 and a scraper 107 ensures that a continuous coating layer 108 of aqueous adhesive is deposited on the conveyor belt 100.

The aqueous adhesive 106 used is based on starch, on dextrin, on sodium carboxymethylcellulose, on sodium carboxyethylcellulose, on polyethylene glycol with high relative molecular mass (greater than 4,000) or on polyvinylpyrrolidone etc. It must have a good adhesive capacity (tack) in conditions for depositing at ambient temperature onto the conveyor belt 100.

Preferably, use is made of a composition comprising an equal distribution by mass of water and of adhesive and the quantity of material deposited is of the order of 1 to 4 g/m$^2$.

The textile support is fed from a roll 109. A cylinder/counter-cylinder assembly 110, 111 situated on either side of the conveyor belt 100 and of the textile support 2 ensures the bringing into contact of one with the other and therefore the bonding of the textile support onto the conveyor belt 100.

Again referring to FIG. 1, two coating layers of polymers distributed in spots 4, 5 are successively applied to the textile support 2, while it is bonded onto the conveyor belt 100, by rotary frames 112 and 113. See FIGS. 1, 2 and 3. The axes of these frames are parallel to one another and perpendicular to the direction of travel of the conveyor belt 100, which it has been seen is stabilized.

These rotary frames, known per se, interact with scrapers 114 and 115 on the one hand and with counter-cylinders 116, 117 on the other hand in order to make the coatings in spots.

These rotary frames make it possible to use methods of coating in the wet way, in which very fine powders of polymers, in aqueous dispersion, are applied to the textile support by a hollow scraper installed inside the rotary roller which has a thin perforated wall. The scraper brings about the passage of the paste through the openings of the cylinder.

An important contribution is made of the invention by having sought and found the means which make it possible to ensure the successive depositing of two coating layers distributed in spots, each spot 5 of the up r being deposited on a spot of the underlayer 4. See FIG. 1.

Figure 4:
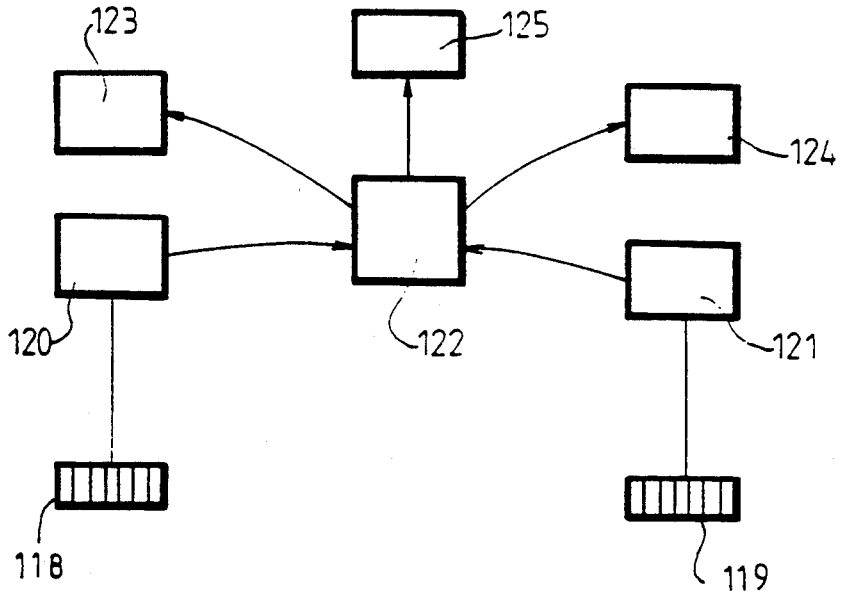
FIG. 4 is a diagrammatic representation of the automatic control method used in the invention.

In order to obtain this coincidence, the speed of rotation of the second rotary frame 113, its angular setting and the speed of advance of the support belt 100 are preferably controlled by the speed of rotation of the first rotary frame 112. This control is effected by an opto-electronic device which is represented diagrammatically in FIG. 4. Each of the cylinders has on its periphery reference marks, 118, 119 respectively, which are read by optical sensors 120, 121. The electric information items provided by these sensors are transmitted to a processing unit 122 which controls, by means of motors 123, 124, 125, the speeds of rotation of the rotary frames 112 and 113 and the speed of advance of the conveyor belt 100.

This control is effected in such a manner that the peripheral speeds of the rotary frames 112 and 113 are equal to the speed of advance of the conveyor belt 100 and therefore of the textile support 2. Each spot 5 of the upper layer is thus deposited on a spot 4 of the lower layer. See FIGS. 1, 2, and 3.

An opto-electronic system makes it possible to effect this control in good conditions. It can also be electro-mechanical, electronic or electro-magnetic.

After the underlayer of polymers 4 and then the upper layer 5 of thermoadhesive polymers have been deposited on the textile support 2, the conveyor belt 100/coated textile support 2, 3, 4 assembly passes through a continuous drying furnace 126. See FIGS. 1, 2 and 3. This furnace is intended to ensure the evaporation of the water and of the dispersion which form the paste deposited by coating, with the thermoadhesive polymers.

Preferably, the temperature of this furnace is close to the melting point of the polymers, and it can be a hot-air furnace, a microwave furnace or a radiant furnace, and it is possibly ventilated.

Good results have been obtained with a drying time of the order of 10 seconds.

After passage through the drying furnace 126, the coated textile support 2, 4, 5 is separated from the conveyor belt 100 and then cooled. It is then stored on a roll 127. See FIGS. 1, 2, and 3.

When the conveyor belt 100 forms a closed loop is subjected to washing by rubbing of the brush 128 which itself is immersed in the bath 129.

The rotary frames 112 and 113 comprise, as has been indicated above, perforations which form the spots 4, 5 respectively during the coating with the underlayer and with the upper layer. See FIGS. 1, 2, and 3.

The dimension of these perforations determines the dimensions of the spots formed.

In general, the distance between the spots of contact of the conveyor belt 100 with the rotary frames 112 and 113 is sufficiently small that, when the upper layer is deposited, the underlayer has not had time to dry. The upper layer is therefore strongly associated with the underlayer at the time of drying.

In contrast, in certain embodiments, drying of the underlayer is required before application of the upper layer. To this end, a second furnace 150 is then positioned between the rotary frame 112 and the rotary frame 113. See FIG. 3. The underlayer, or first layer, is subjected to an ultra violet, microwave, high frequency treatment or electron beam treatment prior to depositing the upper layer.

Until now, the method for production of the fabric covering from a polymer paste has been described. In order to increase the volume of the spots 3 and in particular the volume of the upper layer of polymers 5, the rotary frame 113 is advantageously fed with a foam containing polymers. This foam is formed in a mixer fed with a pasty dispersion of polymers, to which a surface-active agent is added and into which air is injected.

The foam thus formed is deposited by the rotary frame. During the passage of the coating through the furnace 126, the air bubbles formed by the foam burst, the corresponding air escapes at the same time as the products disperse and allow the thermoadhesive polymers to subsist.

The use of accurately engraved printing frames is important for the quality of the result. It is important that the second rotary frame 113 is a perfect replica of the first frame 112. This means that the centers of the engravings corresponding to each of the coating spots 4, 5 correspond, even if the dimensions of each spot 5 of the second rotary frame 113 are smaller than those of the spot 4 of the first rotary frame 112 as was indicated above. See FIGS. 1, 2, and 3. Different techniques for manufacturing the printing frames can be used:

they can be made by roll-embossing. A matrix, intended for the production of the frames, is then engraved by an embossed roll of small diameter which bears the pattern of the engraving. This matrix is then put in an electrolytic bath in order to make possible the manufacture of the frames.

According to a second technique, the pattern of the engraving is made by a computer. The coordinates of this pattern are used to control a numerically-controlled laser which engraves on a roller sleeve, which has previously been covered with crosslinked resin, the electrolytic deposit zones which will surround the passage holes formed on the frames.

These techniques make it possible to obtain designs with an accuracy of the order of 10 microns for hole diameters of the order of 500 to 1,000 microns.

The underlayer 4 of the thermoadhesive fabric covering preferably has a small thickness. This thickness, determined by the thickness of the first rotary frame 112, is preferably between 0.05 mm and 0.20 mm. The underlayer is deposited in the form of a single aqueous phase dispersion constituted by a water/thickener/-polymer mixture. Preferably, the polymers are crosslinking. The best results have been obtained with dispersions based on crosslinkable silicones, on fluorinated polyethylenes, on crosslinkable polyurethanes, and on polyacrylates.

An important role of the underlayer is to prevent the penetration of the upper layer through the textile support 2 while preserving the physical textile properties of this textile support 2.

The upper layer 5 preferably has a thickness between 0.4 mm and 0.8 mm. See FIG. 1.

The aqueous dispersion used for the coating of the upper layer preferably has the following composition (by mass):

40–60% water
25–35% thermoadhesive polymers
1 to 2% ammoniated polyacrylate thickener
25–35% dispersion.

The thermoadhesive polymer is a polyamide, a copolyamide, a polyester, a copolyester, a polyurethane, a polyethylene etc. or a mixture of these different polymers.

In another embodiment, use can also be made of reactive systems as thermoadhesive polymers, such as styrene-ethyl acrylate, melamines, aziridine, isocyanates, unsaturated polyesters, epoxy resins or, more generally, any polymer having a reactive function.

The dispersion is a mixture of solvents, of plasticizers, of fatty acids, and of ammonium polyacrylates. It also comprises a rheology agent and a thixotropic agent.

The mixture of these different components constitutes a paste which must be homogeneous and the components of which do not risk separating from one another at the time of implementation of the method. The viscosity of this paste is reduced at the time of its passage through the frame and then it increases and the spot increases in volume during passage through the furnace.

The thickness of the second frame 113, which produces the thickness of the upper layer, depends on the spot density of the coating.

For a 30 mesh coating (approximately 200 spots/$m^2$), the thickness of the second frame 113 is preferably between 10 and 13 hundredths of a millimeter.

For an 11 mesh coating (20 spots/$m^2$), a frame having a thickness between 16 and 20 hundredths of a millimeter is used.

The mass of polymers deposited in the underlayer is between 1 and 4 g/$m^2$ and the mass of polymers deposited in the upper layer is between 4 and 14 g/$m^2$.

Implementation of the invention makes it possible to produce thermoadhesive fabric coverings, on which the polymer spots are distributed accurately. They ensure considerable swelling, a large volume, good flexibility and good resilience of the textile complex of which they form part.

What we claim is

1. A method for the production of thermoadhesive fabric coverings, in which a textile support receives a coating of thermoadhesive polymers distributed in spots upon the textile support, comprising the steps of:

bonding the the textile support onto a conveyor belt;

depositing a first layer of thermoadhesive polymers in spots upon the textile support by a first perforated rotary frame;

depositing a second layer of thermoadhesive polymers in spots identical to that of the first layer and upon the first layer of thermoadhesive polymers by a second perforated rotary frame;

separating the coated textile support from the conveyor belt;

passing the coated textile support through a continuous drying furnace and;

cooling said coated textile support.

2. The method for production of thermoadhesive fabric coverings as claimed in claim 1, wherein the conveyor belt forms a closed loop.

3. The method for the production of thermoadhesive fabric coverings as claimed in claim 2, wherein the conveyor belt is washed after separation from the textile support and before receiving a new textile support element for coating.

4. The method for production of thermoadhesive fabric coverings as claimed in claim 1, further comprised of a support belt, wherein the speed of rotation and angular setting of the second perforated rotary frame and the speed of advance of the support belt are controlled by the speed of rotation of the first perforated rotary frame in such a manner that the peripheral speeds of the first and second perforated frames are equal to the speed of advance of the support belt so that each spot of the first layer is deposited on a spot of the second layer.

5. The method for production of thermoadhesive fabric coverings as claimed in claim 4, wherein, for each spot, the dimension of the perforation of the second rotary frame is equal to or smaller than the dimension of the perforation of the first rotary frame.

6. The method for production of thermoadhesive fabric coverings as claimed in claim 1, wherein the polymers of the first layer are at least partially crosslinked after being deposited on the textile support.

7. The method for production of thermoadhesive fabric coverings as claimed in claim 1, wherein the polymers of the second layer are heat-fusible.

8. The method for production of thermoadhesive fabric coverings as claimed in claim 1, wherein the polymers of the second layer are deposited in the form of a paste.

9. The method for production of thermoadhesive fabric coverings as claimed in claim 1, wherein the polymers of the second layer are deposited in the form of a foam.

10. The method for production of thermoadhesive fabric coverings as claimed in claim 1, wherein the first layer contains at least one agent capable of chemically reacting with the thermoadhesive polymers of the second layer.

11. The method for production of thermoadhesive fabric coverings as claimed in claim 1, wherein the first layer is dried after being deposited on the textile support and before the second layer is deposited.

12. The method for production of thermoadhesive fabric coverings as claimed in claim 1, wherein the first layer is subjected to a treatment selected from the group consisting of ultraviolet, microwave, high frequency, and electron beams before the second layer is deposited.

13. A thermoadhesive fabric covering which comprises a textile support having a first and second surface and a thermoadhesive coating distributed in spots on said first and second surfaces wherein each spot of the coating comprises a first layer formed from polymers and a second layer formed from thermoadhesive polymers dissimilar to the polymers of the first layer, the first layer being arranged under the second layer.

14. The thermoadhesive fabric covering as claimed in claim 13, wherein the first layer of each spot is formed from heat-stable crosslinked polymers.

15. The thermoadhesive fabric covering as claimed in claim 13, wherein the second layer of each spot has a surface area which is equal to or smaller than that of the first layer.

16. The thermoadhesive fabric covering as claimed in claim 13, wherein the first layer comprises polymers selected form the group consisting of crosslinkable silicones, fluorinated polyethylenes, crosslinkable polyurethanes, and polyacrylates.

17. The thermoadhesive fabric covering as claimed in claim 13, wherein the second layer comprises polymers selected from the group consisting of polyamides, copolyamides, polyesters, copolyesters, polyurethanes, and polyethylenes.

18. The thermoadhesive fabric covering as claimed in claim 13, wherein the second layer comprises polymers having a reactive function selected from the group consisting of copolymers styrene-ethyl acrylate, melamines, aziridine, isocyanates, unsaturated polyesters and epoxy resins.

* * * * *